United States Patent [19]

Raasch

[11] Patent Number: 4,891,933

[45] Date of Patent: Jan. 9, 1990

[54] METHOD AND APPARATUS FOR THE RAPID REESTABLISHMENT OF OPERATION OF A TEXTILE SPINNING MACHINE

[75] Inventor: Hans Raasch, Monchengladbach, Fed. Rep. of Germany

[73] Assignee: W. Schlafhorst & Co., Fed. Rep. of Germany

[21] Appl. No.: 300,955

[22] Filed: Jan. 23, 1989

[30] Foreign Application Priority Data

Jan. 23, 1988 [DE] Fed. Rep. of Germany ..... 3801965

[51] Int. Cl.[4] ..... D01H 9/10; D01H 9/18; D01H 15/02; B65H 54/02

[52] U.S. Cl. ..... 57/269; 57/263; 57/270; 242/18 FW

[58] Field of Search ..... 57/261, 263, 266, 268, 57/269, 270; 242/35.5 A, 18 EW

[56] References Cited

U.S. PATENT DOCUMENTS

| | | | |
|---|---|---|---|
| 3,855,771 | 12/1974 | Yoshizawa et al. | 57/269 |
| 4,125,990 | 11/1978 | Stahlecker et al. | 57/269 X |
| 4,139,162 | 2/1979 | Stahlecker | 57/263 X |
| 4,539,803 | 9/1985 | Ferro | 57/263 |
| 4,628,685 | 12/1986 | Stahlecker et al. | 57/261 X |
| 4,630,782 | 12/1986 | Rohner | 242/18 EW |
| 4,653,261 | 3/1987 | Schreiber et al. | 57/263 |
| 4,736,898 | 4/1988 | Raasch et al. | 242/18 EW |

*Primary Examiner*—Donald Watkins
*Attorney, Agent, or Firm*—Shefte, Pinckney & Sawyer

[57] ABSTRACT

A method and apparatus for reestablishing the spinning operation of an open-end spinning machine following completion of spinning of a full package. The apparatus uses a traveling service unit having a device for forming a yarn reserve on a projecting end of a full package, a device for removing the full package with the yarn reserve thereon, a device for placing an empty tube in position for winding, a device for preparing an end of auxiliary yarn for restart feeding to the spinning element, a device for feeding the end of auxiliary yarn to the spinning element to restart spinning and withdrawing restarted yarn from the spinning element, and a device for engaging the restarted yarn on the empty tube to reestablish the spinning operation. The forming of the yarn reserve is performed while the end of auxiliary yarn is being prepared for restarting of spinning. The package is removed while the auxiliary yarn end is being fed to the spin box for restarting of spinning. The new tube is being placed while restarted yarn is being withdrawn from the spin box and being fed onto the tube. The normal spinning operation is then resumed.

6 Claims, 7 Drawing Sheets

METHOD AND APPARATUS FOR THE RAPID REESTABLISHMENT OF OPERATION OF A TEXTILE SPINNING MACHINE

BACKGROUND OF THE INVENTION

The present invention relates to a method and apparatus for rapidly reestablishing the spinning operation of a spinning station of a spinning machine after an interruption thereof due to the completion of the building of a yarn package.

An open-end spinning machine typically has a plurality of spinning stations, at which spinning elements, such as rotors, generate spun yarn that is cross-wound onto packages. Traveling service units travel to the spinning stations to restart the spinning operation after a full package is replaced by an empty tube. The package removal and new tube placement operations are performed either by devices at each spinning station or by devices on a service unit. Some service units include devices for forming reserve yarn windings on tube ends projecting from the full packages prior to removing the packages. Other service units on the machine have devices for preparing ends of auxiliary yarn for feeding to the spinning element for restarting the spinning and withdrawing the restarted yarn for engaging on the empty tubes. Some machines have traveling service units that combine devices for package removal, tube placing, auxiliary yarn end preparing and feeding, and spinning restarting.

As the reserve yarn forming, package replacing, tube placing, auxiliary yarn preparing, auxiliary yarn feeding and restarted yarn withdrawing, and the restarted yarn engaging operations are all performed with the spinning station out of operation, it is desirable to reduce the overall time of performing these operations as much as possible to reduce down time and thereby increase productivity.

SUMMARY OF THE INVENTION

The present invention provides a method and apparatus for reestablishing the spinning operation of a spinning station of a spinning machine after an interruption due to the completion of the building of a yarn package by performing the various required operations of reserve yarn forming, package removal, empty tube placement, auxiliary yarn end preparing, auxiliary yarn end feeding and restarted yarn withdrawal, and restarted yarn engagement on the empty tube using devices that are capable of performing operations simultaneously to thereby reduce down time and increase productivity.

Briefly described, the present invention provides a method for reestablishing the spinning operation of an open-end spinning machine following completion of spinning of a full package. The spinning machine is of the type having a plurality of spinning stations at which yarn is spun using spinning elements and has a traveling service unit that includes devices for automatically forming a yarn reserve on a projecting end of the package, removing the package, placing an empty tube in position for winding yarn thereon and restarting spinning of yarn from the spinning element onto the empty tube. The method includes forming a yarn reserve on a projecting end of a full package, removing the full package with the yarn reserve thereon, placing an empty tube in position for winding. Advantageously, the further operations of preparing an end of auxiliary yarn for restart feeding to the spinning element, feeding the end of auxiliary yarn to the spinning element to restart spinning and withdrawing restarted yarn from the spinning element, and engaging the restarted yarn on the empty tube to reestablish the spinning operation are performed during the reserve forming, package removing and tube placing operations.

In one embodiment of the method of the present invention, the preparing of an end of auxiliary yarn is performed during the yarn reserve forming, and the feeding of the end of auxiliary yarn, withdrawing of restarted yarn, and engaging of yarn on the tube are all performed during the package removing and tube placing. In the preferred embodiment of the present invention, the package removing is performed during the feeding of the end of auxiliary yarn, and the tube placing is performed during the withdrawing of restarted yarn and engaging of the restarted yarn on the tube.

According to the apparatus of the present invention, a traveling service unit for an open-end spinning machine for reestablishing the spinning operation at spinning includes a device for forming a yarn reserve on a projecting end of a full package, a device for removing the full package with the yarn reserve thereon, a device for placing an empty tube in position for winding, a device for preparing and end of auxiliary yarn for restart feeding to the spinning element, a device for feeding the end of auxiliary yarn to the spinning element to restart spinning and withdrawing restarted yarn from the spinning element, and a device for engaging the restarted yarn on the empty tube to reestablish the spinning operation. The reserve forming device and the auxiliary yarn end preparing device are operably independent for simultaneous operation. Preferably, the package removing device and the auxiliary yarn end feeding and restarted yarn withdrawing device are operably independent for simultaneous operation. In the preferred embodiment the auxiliary yarn end feeding and restarted yarn withdrawing device and the restarted yarn engaging device are operably independent of the tube placing device for simultaneous operation.

Thus, the present invention provides a method and apparatus whereby the reserve yarn end forming, package removing and empty tube placing can be performed simultaneously with the spinning restarting operations to, thereby, reduce the overall operating time and increase productivity of the spinning machine.

Other advantages and features of the present invention will be apparent from the accompanying drawings and following detailed description of the preferred embodiment.

DETAILED DESCRIPTION OF THE PREFERRED EMBODIMENT

Figure 1:
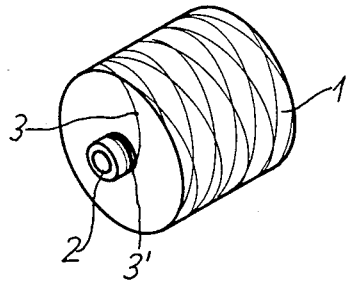
FIG. 1 is a perspective view of a package provided with a yarn reserve winding according to the present invention.

FIG. 1 illustrates a yarn package 1 that has had a reserve yarn winding 3' formed from the end of the wound yarn 3 and removed from a spinning machine during performance of the preferred embodiment of the method of the present invention and using the preferred embodiment of the apparatus of the present invention.

Figure 2:
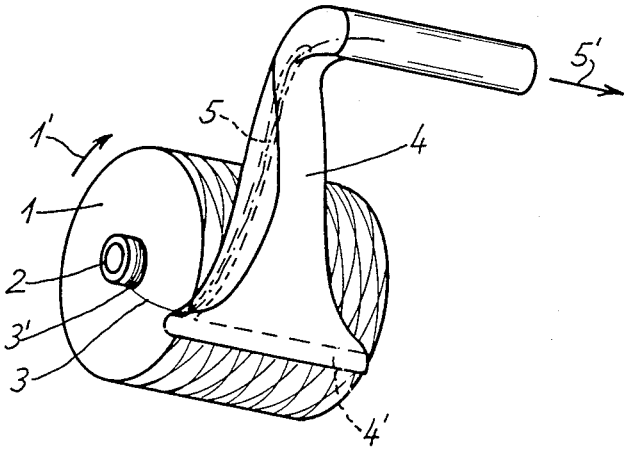
FIG. 2 is a perspective view of a device for locating and drawing off the yarn end from the surface of the package of FIG. 1.

In FIG. 2, a yarn locator for locating and drawing off the yarn end from the surface of package 1 is illustrated in the form of a suction nozzle 4 having a mouth 4' on its lower end which mouth is directed toward the surface of the package 1. The suction nozzle 4 includes a guide slot 5 for the yarn drawn in by suction from the package 1. The guide slot 5 begins at one end of the suction mouth 4' and runs obliquely over the wall of the nozzle 4 facing the package. Arrow 1' indicates the direction of rotation of the package 1 during the normal winding process. In order to draw in the yarn end, the package 1 is rotated counter to the direction of arrow 1'. The yarn end passes thereby and is drawn into the suction mouth 4', whereupon the yarn end is acted on by the air flowing in the direction of arrow 5' and guided into the guide slot 5. The package 1 is then rotated in the direction of arrow 1' so that the aspirated yarn end slides down to the left in guide slot 5 to the left end of the suction mouth 4', whereafter it slides over the package edge as a yarn chord and passes onto the package tube 2, being wound as a reserve yarn winding 3' during the further rotation of the package 1.

Other apparatus for drawing in the yarn end by suction and guiding it by means of mechanical guide elements to the package tube end can be used in lieu of the nozzle 4.

Figure 3:
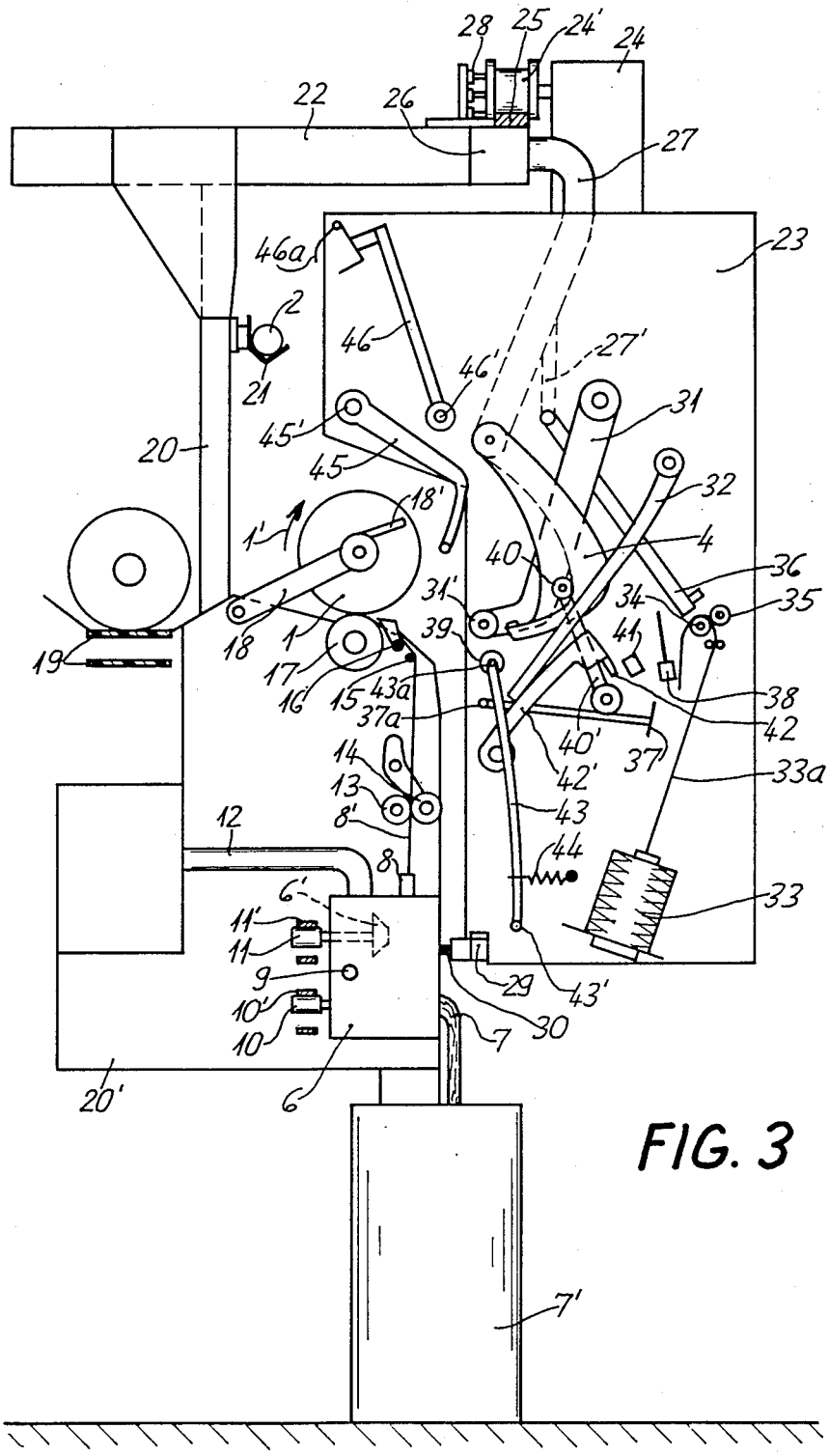
FIG. 3 is a side elevation of a spinning station with a traveling service unit thereat incorporating the apparatus of the preferred embodiment of the present invention.

At the spinning station illustrated in FIG. 3, a spin box 6 is illustrated having a rotatable spinning element, e.g., a rotor 6', to which a sliver 7 is drawn from a sliver can 7' and spins a yarn 8' according to a conventional open-end spinning method, with the yarn being drawn off by a draw-off sleeve 8 from the spin box 6. A drawing-in drive 9 draws sliver continuously into the spin box 6, with the sliver being opened into individual fibers by an opening device which is driven by a conventional opening drive 10 (not shown). The fibers are recombined in the spinning element 6', driven by a drive 11, and pass from the spin box as yarn 8'. Instead of a rotor, friction rollers can be used as spinning elements. Drives 10, 11 are whorls which are driven by tangential belts 10', 11'.

Air for fiber transport is drawn off by suction out of the spin box 6 via a vacuum air connection 12. Yarn 8' is drawn off at a constant speed by draw-off roller 13 cooperating with a clamping roller 14 resting in a resilient manner on the yarn and on the draw-off roller. The yarn 8' traverses in the immediate vicinity of the package 1 so that yarn 8' is deposited in crossing windings and layers on the package 1 rotated in the direction of arrow 1' by a winding drive 17 as the package 1 is pivotably held in a creel 18.

When the desired package fullness has been reached, a yarn break is automatically produced and the particular spinning station is therefore taken out of operation until the package 1 is removed onto a package conveyor belt 29 and an empty tube is placed in the creel for spinning of a new package.

A plurality of supports 20 fastened to the machine frame 20' hold a carrier construction 22 having a rail 25 along which an automatic spinning-restart service unit 23 travels to service the spinning stations of the open-end spinning machine. A plurality of magazines 21 with a supply of tubes 2 are fastened to the supports 20.

The service unit 23 includes a traveling drive mechanism 24 whose rollers 24' rest on the rail 25. A suction chamber 26 is located under the rail 25 to conduct vacuum air from a suction connection 27 on the service unit 23. A plurality of contact rails 28 supply the service unit 23 with electric power. The service unit 23 is supported at its lower end by a plurality of support rollers 29 rolling on a support rail 30 located on the spin boxes 6 of the individual spinning stations.

A package rotating device 31 for rotating the package 1 is pivotably mounted on the housing of the service unit 23 and includes a pivotable arm having a drive roller 31' rotatably mounted on its free end. The drive roller 31' has a built-in motor and can be reversibly driven. A creel lifter 32 is also pivotably mounted on the housing of the service unit 23 and is arranged in such a manner that it can extend under a finger 18' of the creel 18 to raise and lower the creel 18. It can also open and close the left creel arm with a lateral motion.

An auxiliary yarn supply package 33 is mounted on the housing of the service unit 23 to supply an auxiliary yarn 33*a* for the restart of spinning. Auxiliary yarn 33*a* is compressively engaged by a feed roller 34 and a clamping roller 35. A feeder arm 36 is connected by a branch line 27' to suction connection 27 and is also pivotably mounted on the housing of the service unit 23. It is hollow and therefore able to draw auxiliary yarn 33*a* from the feed roller 34 by suction when it is in the position shown in FIG. 3. It brings drawn-in auxiliary yarn 33*a* into the range of draw-off roller 39 with a pivoting movement whereupon the roller takes over the drawing of the yarn 33*a* during the spinning-restart. The feeder arm 36 can pivot to a position adjacent the right or rear package tube-receiving plate of the creel 18 to guide the yarn in such a manner that the yarn is grasped by the tube plate and clamped in between the tube plate and the tube.

The yarn can be held on the draw-off roller 39 by the positioning of a clamping roller 40. A draw-down device 37 pivots about a pivot point 37a and draws a yarn drawn in by the suction nozzle 4 downwardly to dispose the yarn into a cutting and untwisting device 41 and into a yarn transfer member 42. In this regard, the draw-down device 37 pivots from an upper position 37' (shown in FIG. 7) and engages the yarn during its pivoting.

The feeder arm 36 pivots in a plane located in the back of the housing of the service unit 23 and can therefore not readily transfer the auxiliary yarn 33*a* segment drawn from the feed roller 34 to the drawn-down device 37. In this instance, the auxiliary yarn 33*a* is guided to the middle for insertion into yarn transfer member 42 and into the cutting and untwisting device 41. This is performed by a guide lever 38, which pivots from the rear to the middle.

The cutting and untwisting device 41 cuts the inserted yarn and prepares the yarn end for the spinning restart operation, e.g., by means of pneumatically untwisting it. The yarn transfer member 42 brings the yarn end by means of a pivoting motion of its arm 42' into the suction range of the spin box sleeve 8.

After the restart of spinning or after the placing of the yarn on the package tube secured in creel 18, the yarn is guided by draw-off roller 39 of the service unit 23 into the normal running position at the spinning station by means of a transfer device 43 pivoting about pivot point 43' counter to the biasing action of traction spring 44. Transfer device 43 carries a small roller 43a on its end which roller is positioned axially parallel to the draw-off roller 39 when the transfer device 43 assumes its rest position shown in FIG. 3. To transfer the yarn, the yarn is pressed from draw-off roller 39 laterally onto roller 43a of transfer device 43 and, at the same time, the winding speed of the package 1 is increased. The transfer device 43 moves in correspondence with the increased winding speed counter to the force of spring 44 in the direction of the spinning station. The yarn loop present between the spinning station and the service unit 23 (shown in FIG. 6) is taken up thereby.

To locate the yarn, the suction nozzle 4 pivots against package 1. After the yarn has been engaged and the reserve winding formed as described above, the suction nozzle 4 pivots sufficiently so that the draw-down device 37 can grasp the engaged yarn in front of the suction mouth 4' (shown in FIG. 7) in order to insert it for the normal spinning restart into cutting and untwisting device 41 and into the yarn transfer member 42.

A package ejector 45 which pivots about a pivot point 45' removes the package 1 from the opened creel 18 onto a package conveyor belt 19. A package tube supplier 46 then pivots about a pivot point 46' to grasp a package tube 2 from a magazine 21 with its gripper 46a and places it in the open creel 18, which then clamps the ends of the tube.

Figure 4:
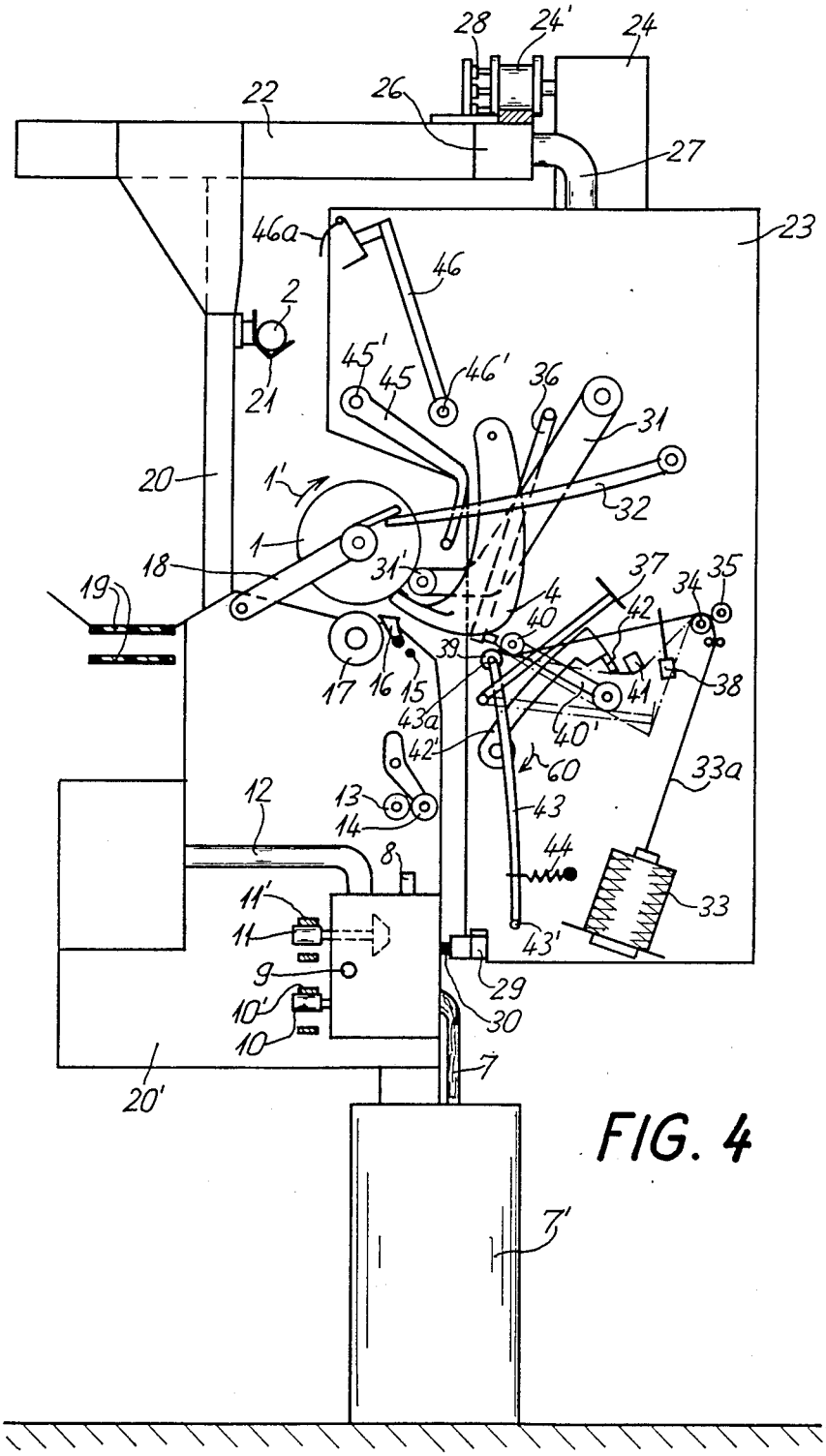
FIGS. 4–7 are side elevations similar to FIG. 3 and illustrating the sequential stages of operation of the apparatus and method of the present invention.

FIG. 3 illustrates the spinning station during normal spinning operation, with a service unit 23 parked directly in front of the spinning station. FIG. 4 illustrates the service unit 23 during a package removal operation. In known manner, the spinning process has been automatically interrupted due to the completion of the building of a package, as measured by the yarn length, the fullness of the diameter of the package 1 and the service unit 23 has been called. The unit 23 can be controlled to stop in front of the spinning station by having the spinning station extend a bar which also initiates at the same time the signal for activating automatic operation of the service unit 23.

In the package removal, the creel lifter 32 reaches under the left creel arm of creel 18 and holds the package 1 in a position which is raised from winding drum 17, as is shown in FIG. 4. The package rotating device 31 pivots against the package 1 to the extent that its drive roller 31' comes to rest against the surface of package 1. Package 1 is now rotated by the drive roller 31' counter to the direction of arrow 1', that is, counter to the direction of winding. The yarn end is taken up thereby by suction nozzle 4. After a preset time, the drive of package 1 is reversed so that the engaged yarn end is wound onto the projecting left end of package tube 2 to form a yarn reserve winding 3'.

Substantially contemporaneously with the reserve winding operation, the feeder arm 36 has engaged the auxiliary yarn 33a on the feed roller 34 by suction and then pivoted with the engaged yarn into the position shown in FIG. 4. Thereafter, the auxiliary yarn 33a is transferred to draw-off roller 39. The auxiliary yarn 33a is clamped by placing clamping roller 40 against draw-off roller 39. Thereafter, the guide lever 38 has pressed the auxiliary yarn 33a to the middle to facilitate grasping thereof by the draw-down device 37 (shown in solid lines in FIG. 4). While pivoting downwardly, draw-down device 37 has engaged the auxiliary yarn 33a and entrained it downward as a loop, as is shown by the lowermost dot-dash line in FIG. 4. The feed roller 34 has, in the meantime, supplied the necessary yarn length. While the yarn loop was being drawn down, the auxiliary yarn 33a has been guided past the yarn transfer member 42 and and the cutting and clamping device 41. Then, the draw-down device 37 has been pivoted upward again while the clamping roller 40 has been opened slightly so that the auxiliary yarn 33a is held under tension by the suction action of the feeder arm 36. Then, the auxiliary yarn 33a is inserted into the clamps of the yarn transfer member 42 and into the cutting and untwisting device 41, as shown in FIG. 4. The auxiliary yarn 33a is cut by the cutting device and its end is opened and untwisted. The one yarn end of the auxiliary yarn 33a is thereby prepared for the restart of spinning while the reserve winding is being formed and the package is being removed. The other yarn end is located in the feeder arm 36.

Figure 5:
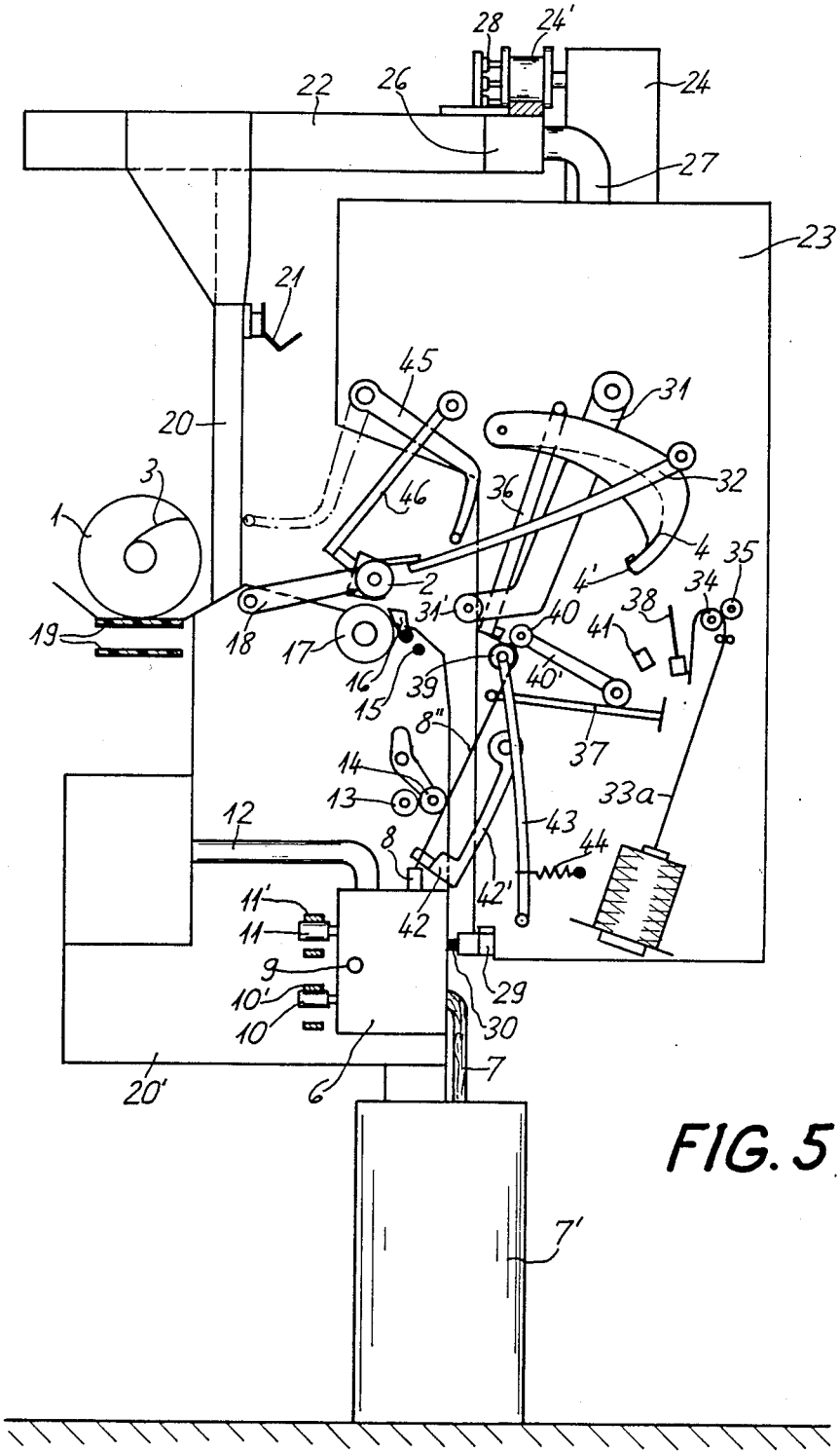

By pivoting the yarn transfer member 42 in the direction of arrow 60 until it moves into the position shown in FIG. 5, the yarn end can be released and pneumatically guided through the sleeve 8 to the spinning element 6'. The yarn end is pieced there with fibers, whereupon the withdrawal of the yarn from the spin box can be resumed.

FIG. 5 illustrates the service unit 23 is a position in which an empty tube 2 is being supplied to the creel 18. The yarn transfer member 42 has been pivoted against the sleeve 8 of the spin box 6 to bring the end of the auxiliary yarn 33a into the suction range of sleeve 8. The draw-off roller 39 has fed the auxiliary yarn 33a from the feeder arm 36 back in the direction of the spin box 6. The spinning-restart time has just been exceeded and the yarn end has been connected with newly introduced fibers and draw-off roller 39 now draws auxiliary yarn 33a and new yarn 8'' spun onto it at a constant speed out of the spin box 6, with the yarn 8'' being drawn by suction into the feeder arm 36.

Prior to the time of the operation illustrated in FIG. 5, the creel lifter 32 has opened the creel 18 and the ejector 45 pivots into the position shown in dotted lines in FIG. 5 in order to transfer the full package 1 from the creel 18 onto the package conveyor belt 19. After the ejector 45 pivots back into its initial position, the tube supplier 46 grasps a tube 2 in the magazine 21 and carries it to the creel 18. The creel lifter 32 has lowered the creel 18 so that it is in the vicinity of winding drum 17 and, closed creel 18 again (which had been open in order to receive package sleeve 2) to clamp the tube 2. The tube supplier 46 then pivots back into its initial position shown in FIG. 3.

Thus, the activities of the package exchange with formation of the yarn reserve, removal of the package and insertion of the new tube takes place at the same time as the spinning restart activities of the drawing of the auxiliary yarn 33a from the supply package 33, the preparation of the yarn end, the guiding of the yarn into the spin box and the placing of the yarn end on fibers in the spinning element, and the feeding of the new yarn 8'' into the feeder arm 36.

Figure 6:
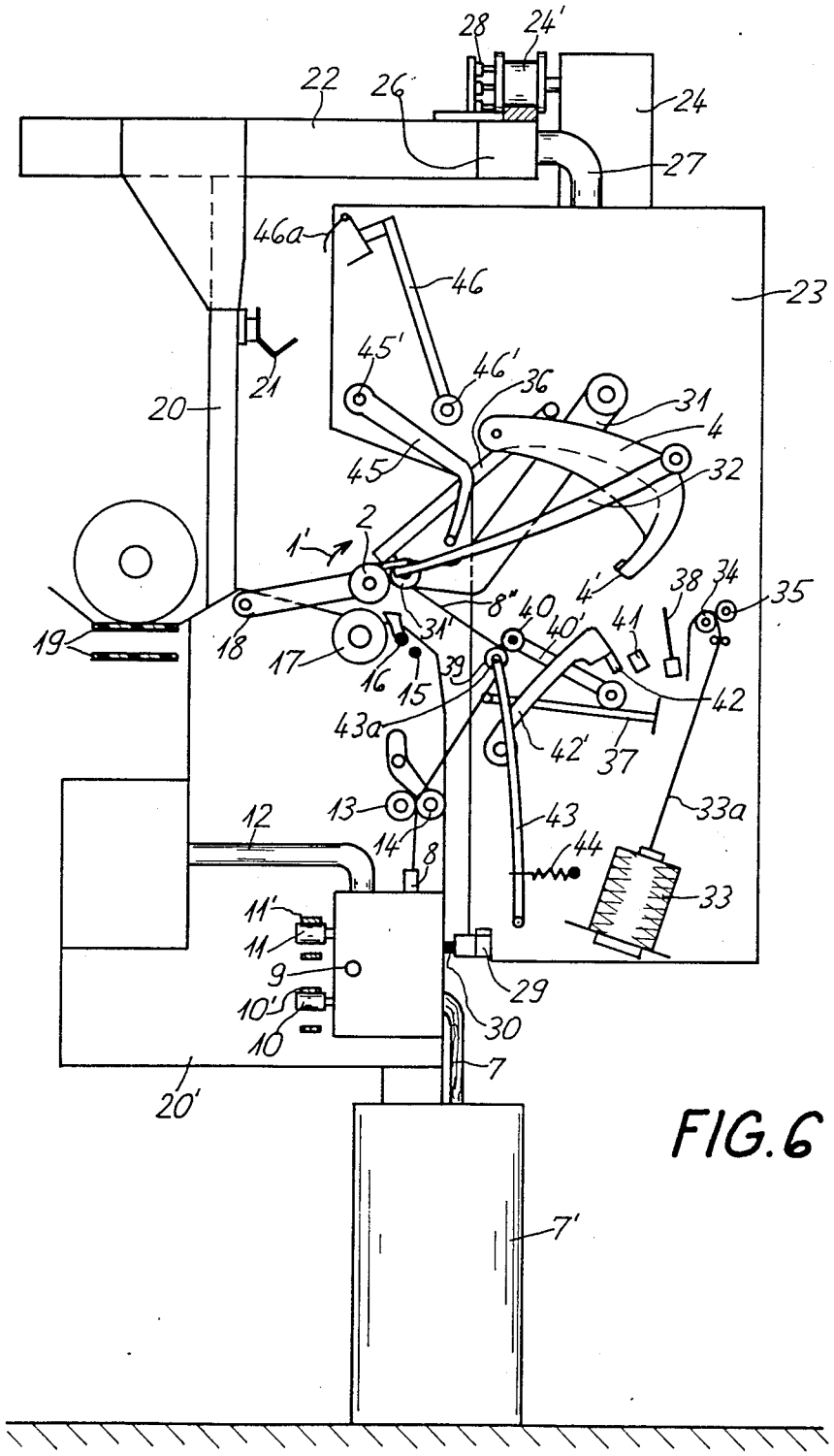

FIG. 6 shows the position of service unit 23 during the engaging of yarn 8'' on the tube 2. The creel lifter 32 holds the creel 18 so that the tube is out of contact with the winding drum 17. The drive roller 31' drives the tube 2 in the direction of arrow 1', that is, in the direction of winding. The feeder arm 36, which engages spun yarn 8'' by suction, pivots past the rear tube plate of the creel 18 to bring the trailing yarn 8'' into a position in which it can engage in slots on the package sleeve plate. After yarn 8'' has been engaged and beings to be wound onto the tube 2, it is severed by a cutting device (not shown) attached to the mouth of the feeder arm 36. The cut-off end, which is connected with the auxiliary yarn end, is removed by suction. The feeder arm 36 can be provided on its end with a contour which guides the yarn on the tube edge so that an initial reserve can form thereon. The foregoing yarn engagement operation is conventional and, therefore, it is not described or illustrated in detail. Then, yarn 8'' is pressed downward by draw-off roller 39 and passed onto a roller **43*a* of the transfer device 43. The yarn loop is taken up by winding at an increased winding speed and as soon as this has occurred, the creel lifter 32 releases the creel 18 causing the tube 2 to come to rest on the winding drum 17. At the same time, the yarn 8'' is grasped by yarn guide 16. The drive roller 31', which is no longer required, is shut down and withdrawn by pivoting of the package rotating device 31. The exchange and spinning-restart process is now terminated and the service unit 23** can leave its parked position and respond to a call for servicing another spinning station.

Figure 7:
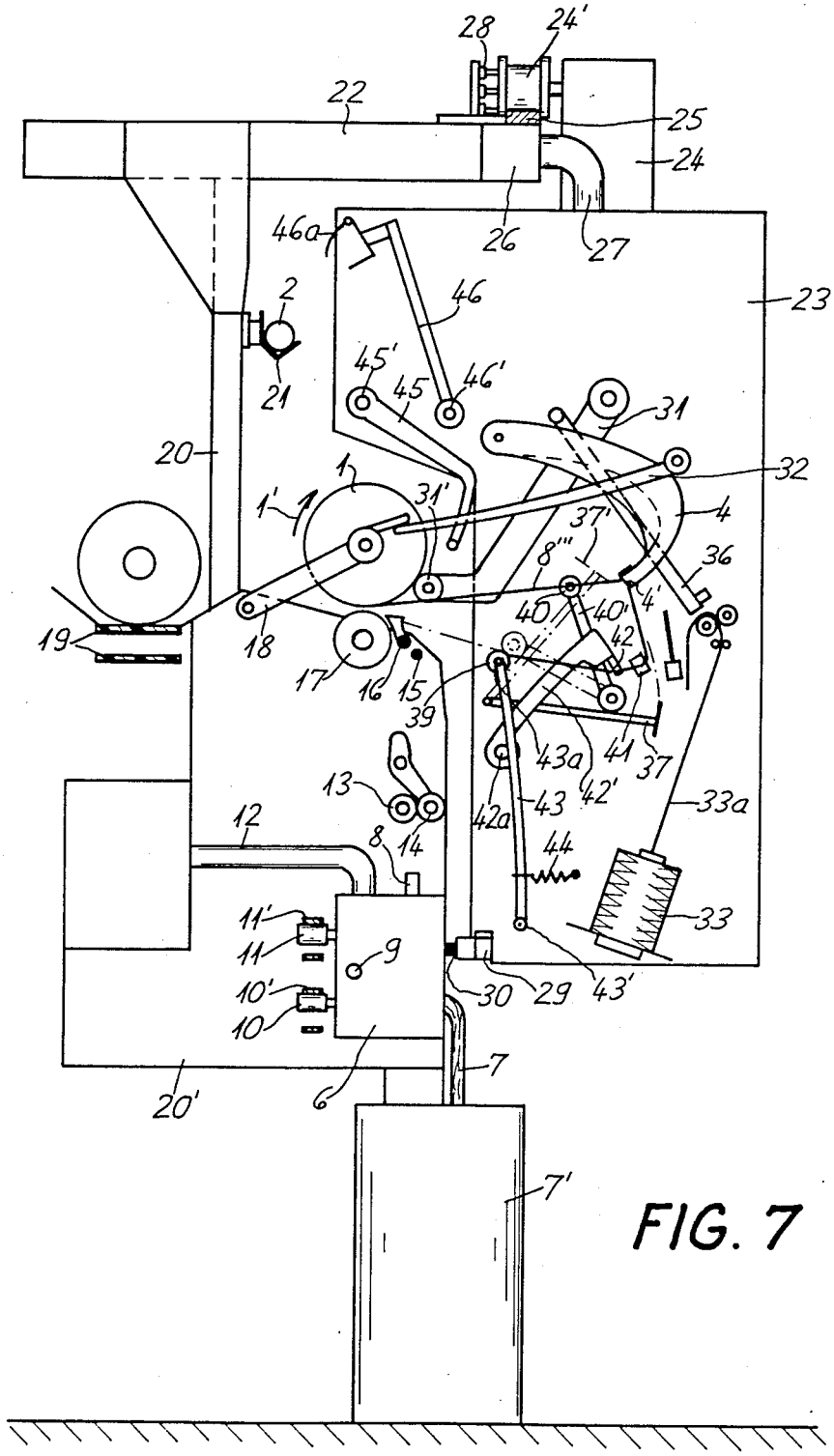

FIG. 7 shows the service unit 23 in preparation for restarting spinning after a normal yarn break at the spinning station. The creel lifter 32 has grasped the creel 18 and lifted the package 1 from the winding drum 17. The driver roller 31' of the package rotating device 31 rests on package 1. The suction nozzle 4 has engaged the yarn end by suction and pivoted back to hold the yarn 8'' under tension. The draw-down device 37 can not pivot up into the position shown in dotted lines, slide past tensioned yarn 8'', then pivot back again and entrain the yarn 8'', drawing it into a loop and onto the draw-off roller 39. Then, clamping roller 40 is placed against draw-off roller 39 by pivoting of its clamping roller lever 40', as shown in FIG. 7 in dotted lines. The drawn-down device 37 now pivots upwardly, thereby causing the yarn loop to slide into the yarn transfer member 42 and into the cutting and untwisting device 41. Yarn 8'' now extends between the suction nozzle 4 and the untwisting device. The new yarn end is untwisted as described above and prepared for respinning. The arm 42' of the yarn transfer member 42 now pivots clockwise about its pivot point **42*a* and carries the new yarn end of yarn 8''' in this manner into the suction range of the sleeve 8 of the spin box 6. The spinning restart now takes place in the same manner as described above. After the spinning restart, the yarn is drawn off draw-off roller 39 and wound with the aid of the transfer device 43 onto the package 1 driven by drive roller 31' in the direction of arrow 1'**. The transfer of the yarn to the spinning station takes place in the manner described above.

It is thus possible with the service unit 23 of the type described to replace packages, restart the spinning with a separate yarn as well as to eliminate normal yarn breaks and start spinning again thereby with the yarn drawn back from the package 1 without using a separate yarn.

With the construction and operation described above, the suction nozzle 4 serves as a device for forming a yarn reserve on a projecting end of a full package; the package ejector 45 serves as a device for removing the full package with the yarn reserve thereon; the tube supplier serves as a device for placing an empty tube in position for winding; the feed roller 34, clamping roller 35, feeder arm 36, draw-down device 37, guide lever 38, and the cutting and clamping device 41 combine to serve as a device for preparing an end of auxiliary yarn for restart feeding to the spinning element; the yarn transfer member 42, feeder arm 36 and draw-off roller 39 combine to serve as a device for feeding the end of auxiliary yarn to the spinning element to restart the spinning and withdrawing restarted yarn from the spinning element; and the feeder arm serves as a device for engaging the restarted yarn on the empty tube to reestablish the spinning operation.

Figure 8:
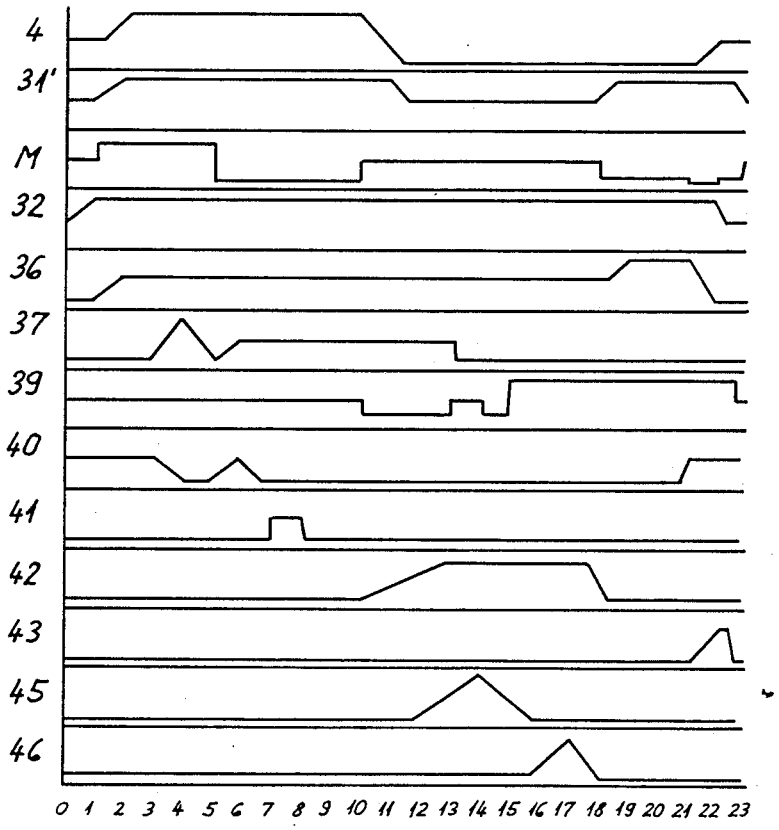
FIG. 8 is a schematic timing diagram illustrating the timing of operation of the components of the apparatus of the preferred embodiment of the present invention in carrying out the method of the preferred embodiment of the present invention.

FIG. 8 show the timing of the various operation which begin after the desired package fullness has been reached and the service unit 23 has assumed its parked position in front of the spinning station and the creel lifter 32 has raised the creel 18 slightly. At time 1, the suction nozzle 4 and the drive roller 31' are placed against the package 1 with the drive roller 31' driving the package 1 in a reverse direction. The feeder arm 36 is actuated to grasp the auxiliary yarn **33*a* and pivot adjacent draw-off roller 39. At time 3, the draw-down device 37 pivots upwardly and the clamping roller 40 comes to rest against draw-off roller 39. At time 4, the draw-down device 37 pivots downwardly. It has reached its lowest position at time 5. It then pivots slightly upward again and at the same time the clamping roller 40 is raised briefly off the draw-off roller 39. From time 1 to time 5, the drive motor M of drive roller 31' is operated in reverse. At time 5, it is shifted to forward at an increased speed. The placement of the clamping roller 40 onto the draw-off roller 39 is initiated at time 6. At time 7, the cutting and untwisting device 41 begins to operate to prepare the yarn end for the spinning restart. At time 8, it has concluded its preparatory activity. At time 10, the winding of the yarn reserve 3' has ended. The drive motor M of drive roller 31' continues to operate. The suction nozzle 4 pivots back and the yarn transfer member 42 begins to pivot toward the spin box 6. To supply the yarn length for the pivot path of the yarn transfer member 42, draw-off roller 39 feeds yarn from the feeder arm 36. At time 11, the activity of the drive roller 31' has ended. At time 12, the package ejector 45 begins to press package 1 out of the creel 18. To this end, the creel lifter 32 executes a lateral movement to open creel 18. At time 13, the yarn transfer member 42 has arrived at the sleeve 8 of the spin box 6. The draw-down device 37 pivots into its initial position and the draw-off roller 39 is disengaged. At time 14, the draw-off roller 39 is reengaged to feed a predetermined yarn length to the spin box 6 wherein the yarn end is connected to the fibers. At the same time, the package ejector 45 terminates its activity. At time 15, the draw-off roller 39 is switched over to rotation for drawing yarn from the spin box and into the feeder arm 36. At time 16, the package ejector 45 has pivoted back into its initial position and, thereafter, the tube supplier 46 pivots against the magazine 21 to receive a tube 2. It then pivots against the creel 18 to deliver the sleeve thereto. Thereafter, the creel lifter 32 closes the creel 18 again to clamp the tube 2 therein. At time 17, the tube supplier 46 begins pivoting back again. At time 18, the tube supplier 46 and yarn transfer member 42 have completed pivoting back. The pivoting of the yarn supplier 42 began between times 17 and 18. At the same time, drive roller 31' is placed against the tube 2 and the driver motor M is switched to forward to drive the tube 2 in the direction of winding. The feeder arm 36 is pivoted further upward so that it moves behind the rear tube plate of the creel 18, such as it shown in FIG. 6. At time 21, the feeder arm 36 pivots back into its initial position. The drive motor M is shifted to a slightly higher drive speed so that the yarn loop present between the service unit 23 and the winding position is taken up by the winding at a more rapid speed. The clamping roller 40 is opened so that the yarn can slide onto the roller 43***a* of transfer device 43, which is pivoted toward the spinning station. At the time 21, the suction nozzle 4, which has been pivoted far to the right for drawing out the yarn, is pivoted back into its initial position, shown in FIG. 3. At time 22, the drive motor M is cut out, the creel lifter 32 is brought into its initial position and the transfer device 43 pivots back into its initial position. At time 23, all operating elements have moved into their rest positions and all drive have been disengaged, with the yarn now being wound on the tube with the normal spinning operation resumed.

From the foregoing description of the timing of the operation of the various components of the apparatus, it is apparent that the locating of the end of yarn on the full package and the forming of the reserve winding occurs during the times 2–10 and during this time, specifically during times 2–8, the end of auxiliary yarn is provided and is prepared for restarting of spinning. Thereafter, during times 10–18, the restarting of the spinning of yarn onto the end of the auxiliary yarn and withdrawing of the restarted yarn takes place, during which time, specifically during times 12–15, the full package is being removed.

During the times 15–18, when the yarn is first being withdrawn after restarting of spinning, the new tube is being replaced, which occurs during times 16 and 17.

Restarted yarn is fed to the tube during times 18–22, while the tube is being rotated during times 17–22, and after time 22 the tube is placed against the winding drum and the restarted yarn is in place for immediate restart of the normal spinning production at the spinning station.

In broader terms, the preparation of the auxiliary yarn for restarting of spinning takes place during the overall reserve winding operation, and the restarting of spinning and feeding of yarn onto the tube takes place during ejection of the package and placing of a new tube, with the resumption of normal operation beginning immediately thereafter.

It will therefore be readily understood by those persons skilled in the art that the present invention is susceptible of a broad utility and application. Many embodiments and adaptions of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for reestablishing the spinning operation of an open-end spinning machine following completion of spinning of a full package, wherein the spinning machine has a plurality of spinning stations at which yarn is spun using spinning elements and has a traveling service unit that includes devices for automatically forming a yarn reserve on a projecting end of the package, removing the package, placing an empty tube in position for winding yarn thereon and restarting spinning of yarn from the spinning element onto the empty tube, said method comprising:

forming a yarn reserve on a projecting end of a full package;

removing the full package with the yarn reserve thereon;

placing an empty tube in position for winding; and during said reserve forming, package removing and tube placing preparing and end of auxiliary yarn for restart feeding to the spinning element;

feeding the end of auxiliary yarn to the spinning element to restart spinning and withdrawing restarted yarn from the spinning element; and engaging the restarted yarn on the empty tube to reestablish the spinning operation.

2. A method for reestablishing the spinning operation of an open-end spinning machine according to claim 1 and characterized further in that said preparing of an end of auxiliary yarn is performed during said yarn reserve forming; and said feeding of the end of auxiliary yarn, withdrawing of restarted yarn, and engaging of yarn on the tube are performed during said package removing and tube placing.

3. A method for reestablishing the spinning operation of an open-end spinning machine according to claim 2 and characterized further in that said package removing is performed during said feeding of the end of auxiliary yarn; and said tube placing is performed during said withdrawing restarted yarn and said engaging restarted yarn on the tube.

4. A traveling service unit for an open-end spinning machine for reestablishing the spinning operation at spinning stations following completion of spinning of full packages from spinning elements at each station, comprising:

a device for forming a yarn reserve on a projecting end of a full package;

a device for removing the full package with the yarn reserve thereon;

a device for placing an empty tube in position for winding;

a device for preparing an end of auxiliary yarn for restart feeding to the spinning element;

a device for feeding the end of auxiliary yarn to the spinning element to restart spinning and withdrawing restarted yarn from the spinning element; and a device for engaging the restarted yarn on the empty tube to reestablish the spinning operation; said yarn reserve forming device and said auxiliary yarn end preparing device being operably independent for simultaneous operation.

5. A traveling service unit for an open-end spinning machine according to claim 4 and characterized further in that said package removing device and said auxiliary yarn end feeding and restarted yarn withdrawing device are operably independent for simultaneous operation.

6. A traveling service unit for an open-end spinning machine according to claim 4 or 5 and characterized further in that said auxiliary yarn end feeding and restarted yarn withdrawing device and said restarted yarn engaging device are operably independent of said tube placing device for simultaneous operation.

* * * * *